US006843086B2

(12) United States Patent
Fitch

(10) Patent No.: US 6,843,086 B2
(45) Date of Patent: Jan. 18, 2005

(54) MAGIC KEYCHAIN

(76) Inventor: John S. Fitch, 105 Old Long Ridge Rd., Stamford, CT (US) 06903

( * ) Notice: Subject to any disclaimer, the term of this patent is extended or adjusted under 35 U.S.C. 154(b) by 0 days.

(21) Appl. No.: 10/423,094

(22) Filed: Apr. 25, 2003

(65) Prior Publication Data

US 2003/0200779 A1 Oct. 30, 2003

Related U.S. Application Data

(60) Provisional application No. 60/375,458, filed on Apr. 26, 2002.

(51) Int. Cl.[7] ..... A44B 15/00

(52) U.S. Cl. ..... 70/456 R; 70/457; 24/3.6

(58) Field of Search ..... 70/456 R, 459, 70/457; 24/3.6; D3/207–212; 206/37.1, 38.1

(56) References Cited

U.S. PATENT DOCUMENTS

| | | | | |
|---|---|---|---|---|
| 692,167 A | | 1/1902 | Schumacher | |
| 726,781 A | | 4/1903 | Stone | |
| 783,091 A | | 2/1905 | Alvord | |
| 1,266,365 A | | 5/1918 | Whittaker | |
| 1,566,192 A | | 12/1925 | Forrest | |
| 1,626,334 A | * | 4/1927 | Falk | 70/457 |
| 2,066,526 A | | 1/1937 | Gladstone | 150/40 |
| 2,433,245 A | * | 12/1947 | Stanton | 70/457 |
| 2,901,903 A | | 9/1959 | Grace | 70/457 |
| 3,124,286 A | * | 3/1964 | Dompier | 70/457 |
| 3,882,704 A | | 5/1975 | Chanok et al. | 70/456 R |
| 3,886,772 A | | 6/1975 | Hocq | 70/456 R |
| 3,886,773 A | | 6/1975 | McGahee | 70/457 |
| 5,722,277 A | | 3/1998 | Williams | 70/456 R |
| 5,809,814 A | * | 9/1998 | Cons | 70/457 |

FOREIGN PATENT DOCUMENTS

| | | |
|---|---|---|
| DE | 128250 | 5/1932 |
| DE | 138586 | 8/1934 |
| FR | 1483898 | 4/1966 |
| SE | 267870 | 3/1927 |

* cited by examiner

*Primary Examiner*—Suzanne Dino Barrett
(74) *Attorney, Agent, or Firm*—St. Onge Steward Johnston & Reens LLC

(57) ABSTRACT

A key chain for retaining objects is provided comprising a rigid curved member with two ends, a chain attached to each of the ends of the curved member, a stop carried on the chain for preventing movement of the object past the stop, and a removable retaining member.

10 Claims, 4 Drawing Sheets

MAGIC KEYCHAIN

This application claims the benefit of Provisional Application No. 60/375,458, filed Apr. 26, 2002.

FIELD OF THE INVENTION

The present invention relates to a device to retain objects such as keys. Specifically, the present invention relates to a key chain that provides ease of placing keys onto a chain and securely holding them thereon.

BACKGROUND OF THE INVENTION

Key chains are known. Key chains provide a flexible holder for keys, which is easily collapsible when placed in a pocket or purse. A key chain allows keys to lay flat and compactly upon one another and excess chain collapses upon itself. Also, the key chain, when extended provides a significant length to hold multiple keys and to easily separate and isolate a specific key when needed.

Key chains allow for easy attachment of keys, as opposed to key rings which must be split to slide the key thereon. This is especially difficult with odd shaped keys with small apertures. Chains obviate this difficulty, however they require a means to close the chain and secure the keys thereon.

Key chains with various closure means are known. There is a risk of the closure means failing and keys being lost. The closure means may be upset by the jostling of keys against one another or other objects encountered while the chain is placed in a pocket or purse. There remains a need for better retaining means.

Modern day advances necessitate that key chains hold a variety of items besides keys. Small electronic devices, such as remote car entry devices and remote car starters are conveniently kept along with keys on a key chain. Convenience items, such as small tools, SWISS ARMY® knives and flashlights are fashioned for key chains. Many membership or identification cards are fitted as small plastic tags with bar codes to be placed upon the key chain, such as health club memberships, grocery store savings cards, and motor club identification cards. Modern technology has designed payment devices to attach to key chains, such as small credit cards and wands that operate on radio frequencies to transmit information to make gasoline purchases. It is crucial that these valuable, information-holding items remain securely on the key chain and are not lost. As a result, there is a demand for a key chain with a retaining means to prevent loss of these valuable items and access to private information.

Also as a result of increased functionality of objects held on key chains, there is a demand for a versatile, compact and sophisticated key chain that provides easy and convenient access to objects thereon.

The present invention relates to a key chain for retaining objects such as a key, comprising a curved member with two ends, the curved member being substantially rigid; a chain attached to each of the ends of the curved member; a stop carried on to the chain for preventing movement of said key past the stop; and a removable retaining member.

DETAILED DESCRIPTION OF THE DRAWINGS

Figure 1:
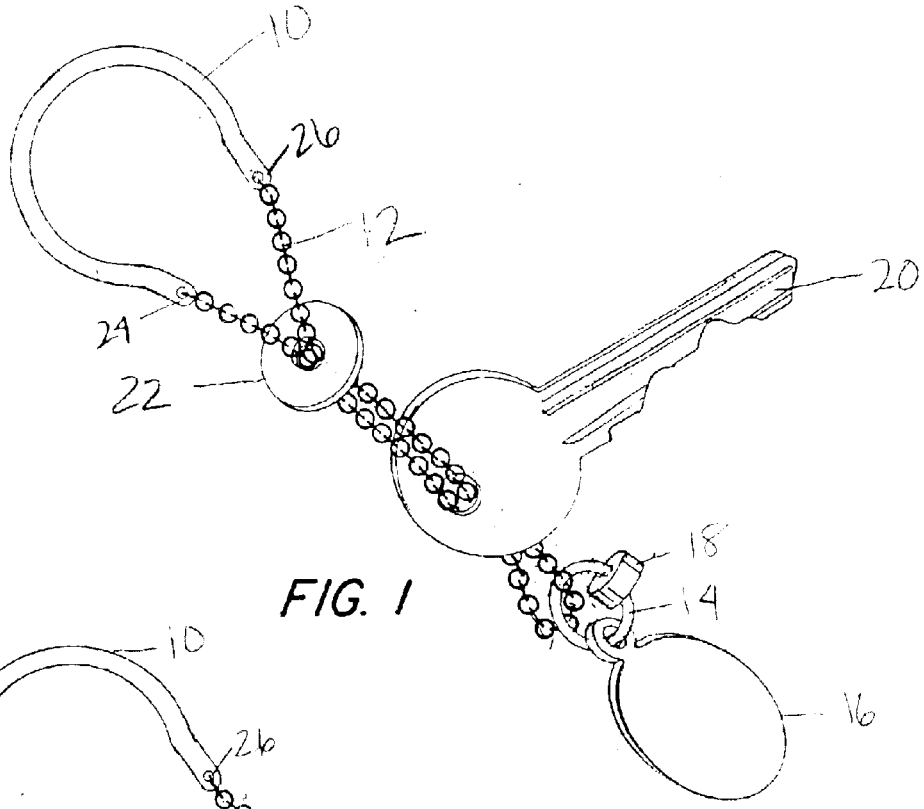
FIG. 1 is a perspective view of an embodiment of the present invention.

FIG. 1 shows a key chain including curved member 10 with ends 24, 26, chain 12 fixedly attached to ends 24, 26 of curved member 10, jumpring 14 disposed on said chain 12, and stop comprising pendant 16 and rondelle 18. Curved member 10 is substantially rigid and preferably U-shaped. Chain 12 is of substantial length to hold several objects such as keys. Curved member 10 and chain 12 are similar in width so that objects can be slid between curved member 10 and chain 12 smoothly and without resistance.

Figure 2:
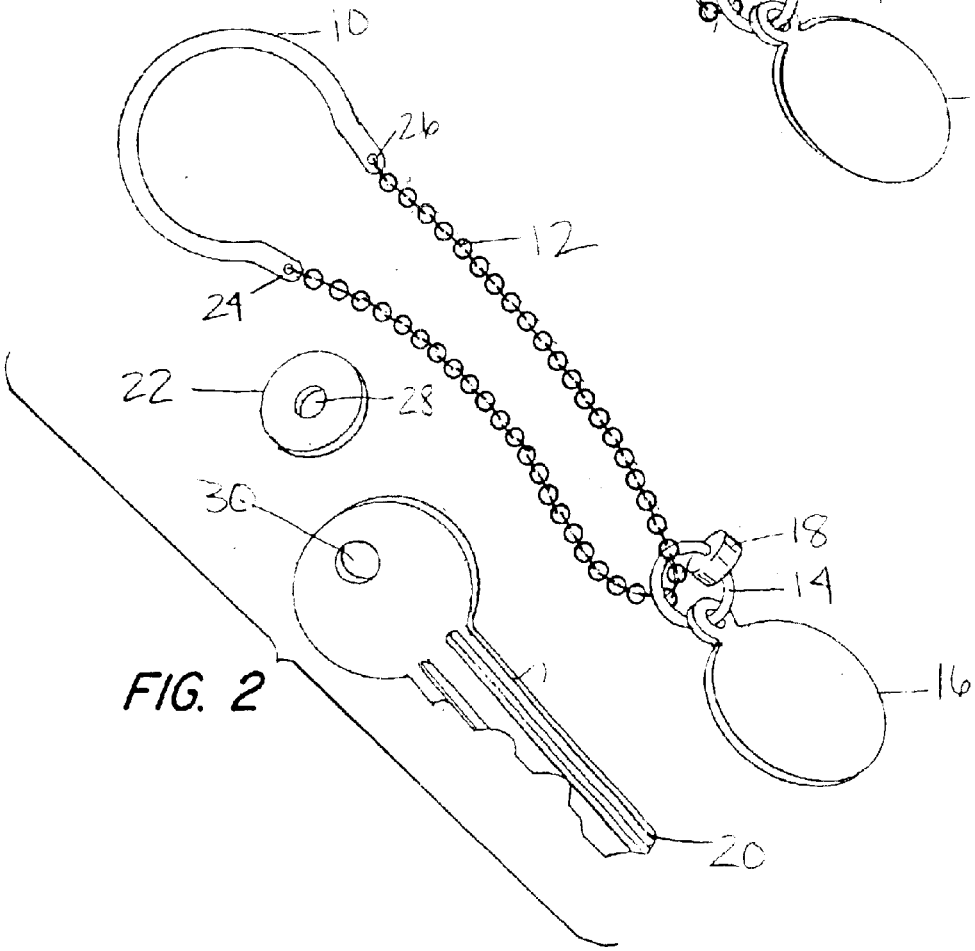
FIG. 2 is an exploded perspective view of the embodiment shown in FIG. 1 illustrating the operation of the present invention.

FIG. 1 shows key 20 held on chain 12 by retaining member 22, which prevents key 20 from sliding off chain 12 onto one end 24, 26 of the curved member 10, along the curved member 10, and off the other end 24, 26 of the curved member 10. As shown in FIG. 2, retaining member 22 has an opening 28 large enough to simultaneously receive curved member 10 and chain 12, or, as shown in FIG. 1, a double chain 10 when in retaining position. Further, retaining member 22 must have a radius no larger than the distance between the ends 24, 26 of the curved member 10 so that it may be removed and placed back on the chain 12 without being blocked by ends 24, 26 of curved member 10. Retaining member 22 is preferably a disk and substantially flat so that it may lie against a key.

Key 20 is prevented from sliding off chain 12 by either pendant 16 and/or rondelle 18. Either pendant 16 or rondelle 18 must be larger than aperture 30 at the top of key 20 such that the key 20 cannot slide off the chain 12 and over pendant 16 or rondelle 18. Aperture 30 of key 20 is smaller than both pendant 16 and rondelle 18. A key with long, narrow apertures may be larger than pendant 16, but not rondelle 18. A key with a circular aperture which may be larger than rondelle 18, will still be stopped by pendant 16. In either instance, the key will be retained.

Figure 3A:
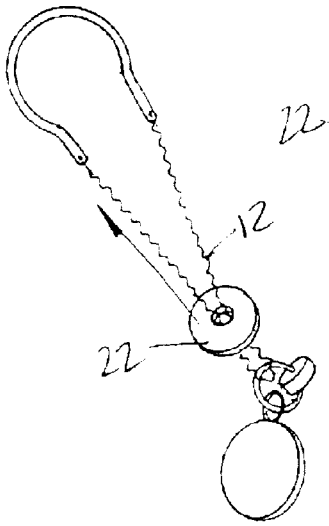
FIGS. 3A–3J are perspective views of the embodiment shown in FIG. 1.
Figure 3B:
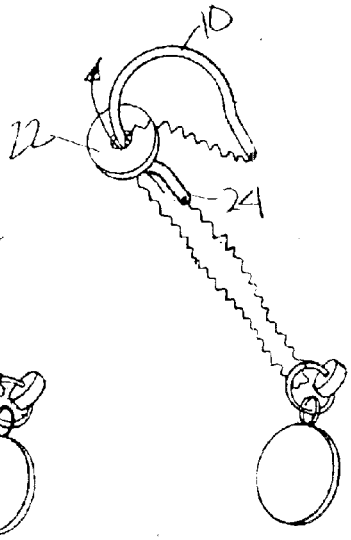
Figure 3C:
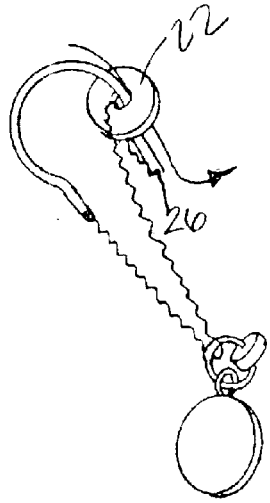

FIGS. 3A–3F depict how objects such as keys are placed onto, retained and removed from the key chain of the present invention. FIG. 3A shows removal of the retaining member 22, up chain 12. FIG. 3B shows removal of retaining member 22 over one end 24 of curved member 10. FIG. 3C shows removal of retaining member along curved member 10 and off other end 26. Because retaining member 22 has an opening 28 slightly larger than curved member 10 and chain 12, it takes precise manipulation to remove the retaining member from the key chain. This prevents accidental removal of retaining member 22, and loss of attached objects such as keys, when the key chain is kept in a pocket or a purse and subject to ordinary jostling therein.

Figure 3D:
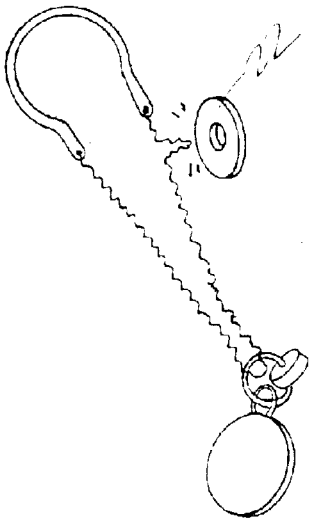

Once the retaining member 22 has been removed from chain 12, as shown in FIG. 3D, and key chain is ready to receive objects.

Figure 3E:
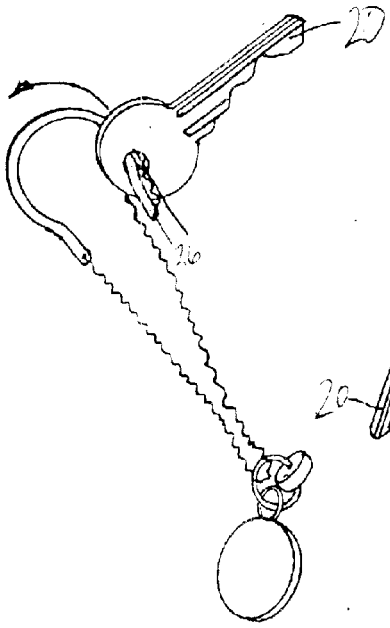
Figure 3F:
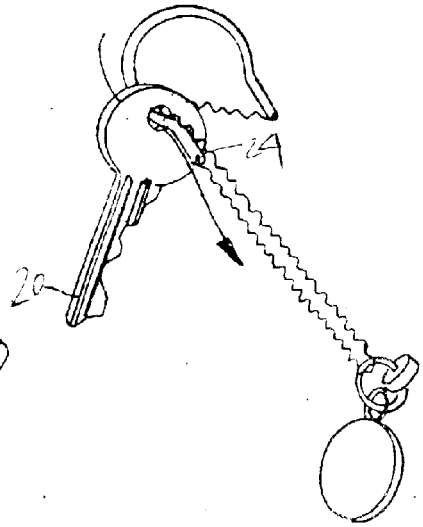
Figure 3G:
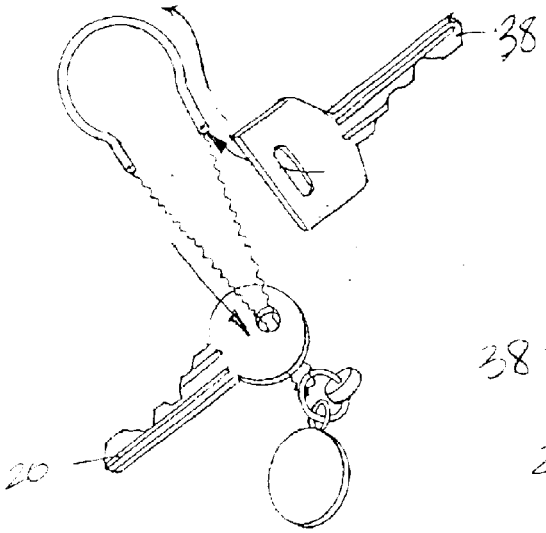

FIGS. 3E–3J shows placement of keys on key chain. In FIG. 3E, first key 20, is placed over one end 26 and slid along of curved member 10. In FIG. 3F, first key 20, is slid over other end 24 of curved member 10. FIG. 3G shows key 20 placed on chain 12 and shows introduction of second key 38 onto key chain.

Figure 3H:
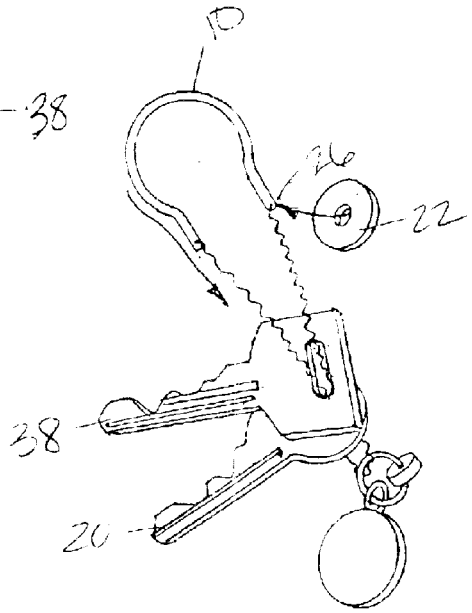
Figure 3I:
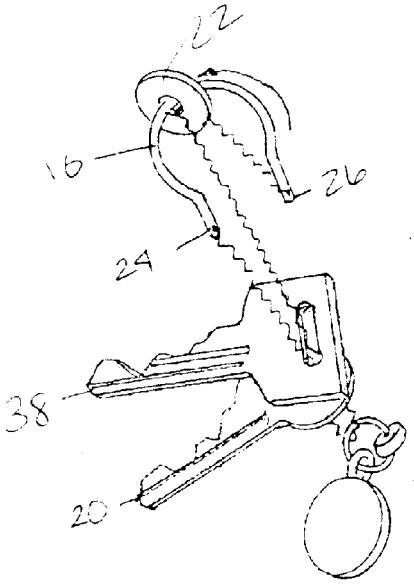

FIG. 3H shows key chain holding keys 20, 38. Retaining member 22 is introduced onto one end 26 of curved member

Figure 3J:
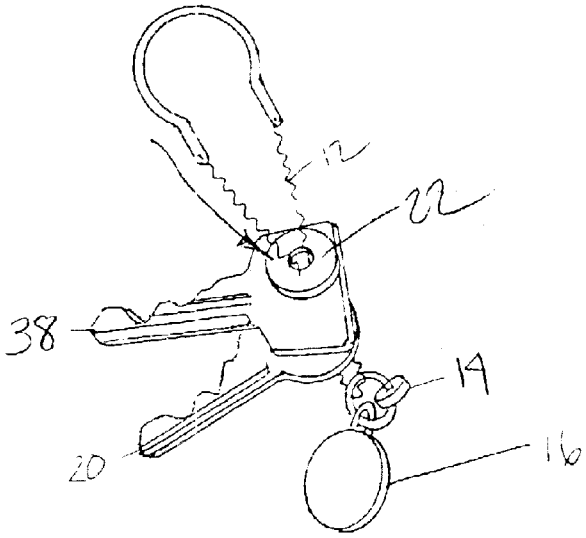

10, along curved member 10 (FIG. 3I), and off other end 24 of curved member 10. In FIG. 3J, shows retaining member 22 in installed position. Retaining member 22 is carried on a double layer of chain 12 and lies flat next to keys 38, 20, position to securely hold them on the key chain between retaining member 22 and stop provided by rondelle 14 and/or pendant 16.

Figure 4:
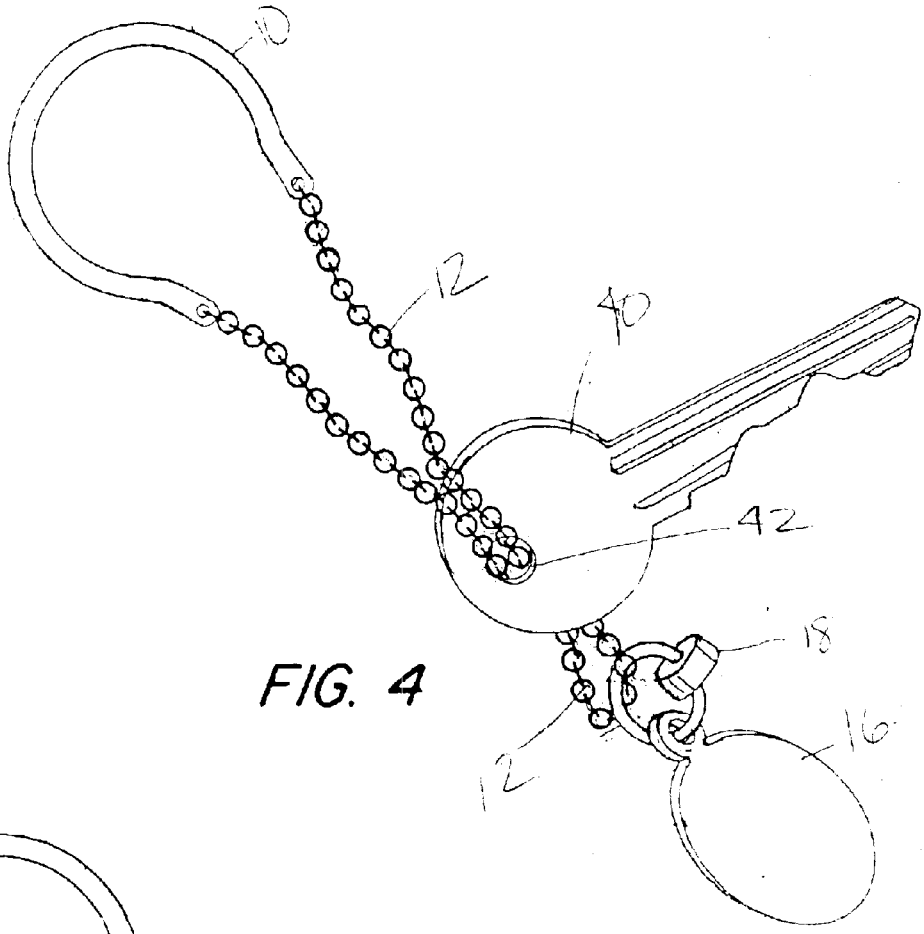
FIG. 4 is a perspective view of another embodiment of the present invention.

FIG. 4 shows another embodiment of the present invention. When key 40 has an aperture 42 small enough to require precise manipulation over the curved member 10 and chain 12, a retaining member is not necessary.

Figure 5:
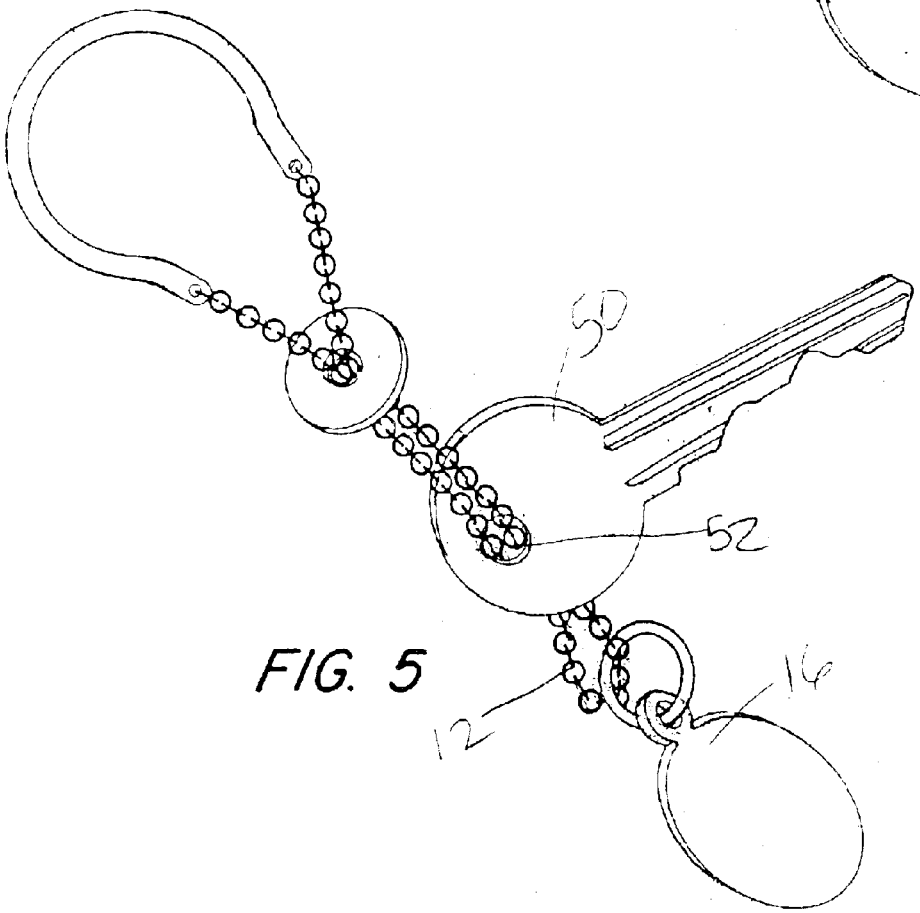
FIG. 5 is a perspective view of another embodiment of the present invention.

FIG. 5 shows another embodiment of the present invention. When key 50, has an aperture 52 smaller than pendant 16, a rondelle is not necessary to retain the key 60 and prevent it from sliding off chain 12. Similarly, if an aperture is long and narrow, such that it may pass over a flat pendant, a rondelle is necessary to prevent loss of the key off the chain 12.

What is claimed is:

1. A key chain for retaining objects with an aperture, comprising:

a curved member with two ends, said member being substantially rigid and said ends separated from each other by a distance;

a continuous single loop of chain attached to each of said ends of said curved member;

a stop carried on said chain for preventing movement of said object past said stop, wherein said stop is larger than said aperture of said object; and a removable retaining member carried on said chain in an installed position, wherein said retaining member has an opening sufficiently large to receive a double layer of said chain and wherein said objects are held on said chain between said stop and said retaining member in said installed position.

2. The key chain of claim 1, wherein said curved member is U-shaped.

3. The key chain of claim 1, wherein said curved member and said chain are of a substantially same diameter allowing said object to easily move from said curved member to said chain.

4. The key chain of claim 1, wherein said retaining member is a circular disk with a radius no larger than said distance between said ends of said curved member.

5. The key chain of claim 1, wherein said opening of said retaining member is sufficiently large to simultaneously receive said curved member and said chain.

6. The key chain of claim 1, wherein said stop is a pendant, said pendant larger in size than said aperture.

7. The key chain of claim 1, further comprising a jumpring attaching said stop to said chain.

8. The key chain of claim 7, wherein said stop comprises a rondelle on said jumpring, said rondelle larger in size than said aperture.

9. The key chain of claim 8, wherein said stop further comprises a pendant.

10. A key chain for retaining objects with an aperture, comprising:

a U-shaped member with two ends, said member being substantially rigid and said ends separated from each other by a distance;

a continuous single loop of chain attached to each of said ends of said curved member, wherein said curved member and said chain are of a substantially same diameter allowing said object to easily move from said curved member to said chain;

a stop carried on said chain for preventing movement of said object past said stop, wherein said stop is larger than said aperture of said object; and a removable retaining member carried on said chain in an installed position, wherein said retaining member is a circular disk with a radius no larger than said distance between said ends of said curved member, wherein said retaining member has an opening sufficiently large to receive a double layer of said chain, and wherein said objects are held on said chain between said stop and said retaining member in said installed position.

* * * * *

US006843086C1

(12) EX PARTE REEXAMINATION CERTIFICATE (9039th)

United States Patent

Fitch

(10) Number: US 6,843,086 C1

(45) Certificate Issued: May 29, 2012

(54) MAGIC KEYCHAIN

(76) Inventor: John S. Fitch, Stamford, CT (US)

Reexamination Request:
No. 90/011,689, May 13, 2011

Reexamination Certificate for:

| | |
|---|---|
| Patent No.: | **6,843,086** |
| Issued: | **Jan. 18, 2005** |
| Appl. No.: | **10/423,094** |
| Filed: | **Apr. 25, 2003** |

Related U.S. Application Data

(60) Provisional application No. 60/375,458, filed on Apr. 26, 2002.

(51) Int. Cl.
*A44B 15/00* (2006.01)

(52) U.S. Cl. ..... 70/456 R; 70/457; 24/3.6

(58) Field of Classification Search ..... 24/3.6; 63/1.12, 23; 70/456 R, 457
See application file for complete search history.

(56) References Cited

To view the complete listing of prior art documents cited during the proceeding for Reexamination Control Number 90/011,689, please refer to the USPTO's public Patent Application Information Retrieval (PAIR) system under the Display References tab.

*Primary Examiner*—Jimmy G Foster

(57) ABSTRACT

A key chain for remaining objects is provided comprising a rigid curved member with two ends, a chain attached to each of the ends of the curved member, a stop carried on the chain for preventing movement of the object past the stop, and a removable retaining member.

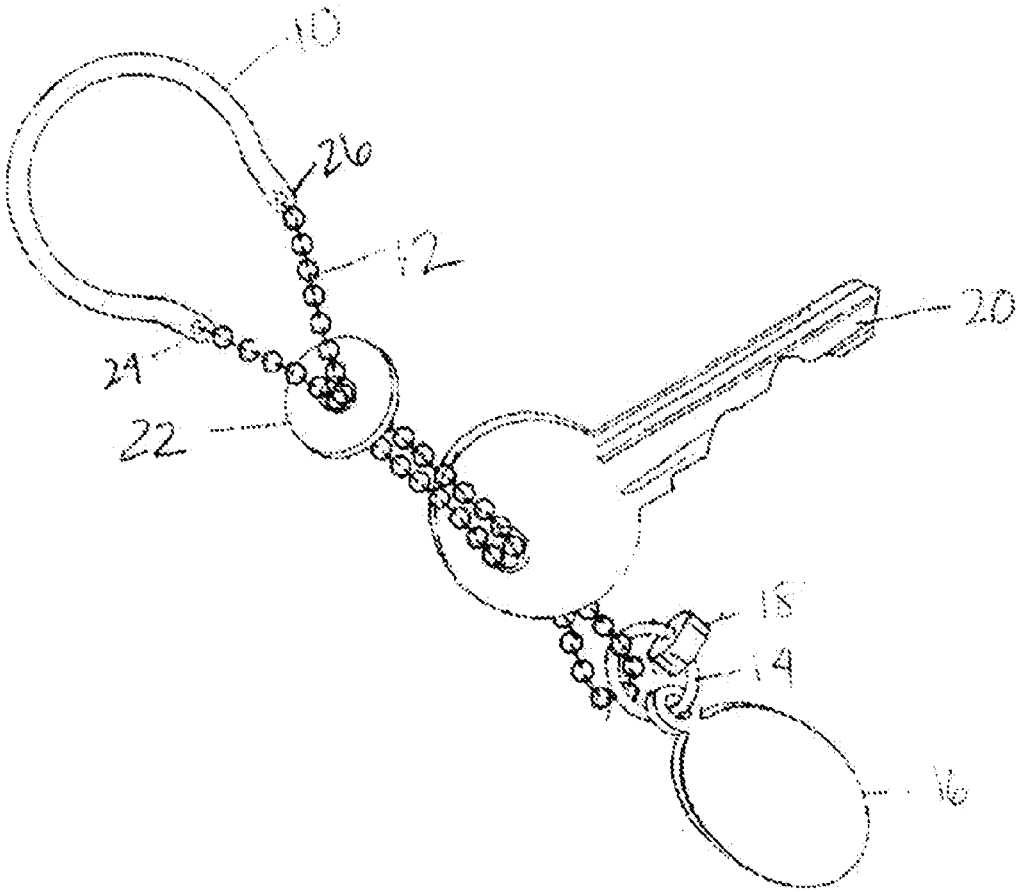

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claims 1, 3, 5, 7 and 10 are determined to be patentable as amended.

Claims 2, 6, 8 and 9, dependent on an amended claim, are determined to be patentable.

New claims 11 and 12 are added and determined to be patentable.

1. A key chain for retaining [objects] *keys* with an aperture, [comprising] *said key chain consisting essentially of*:

a curved member with two ends, said member being substantially rigid and said ends separated from each other by a distance;

a continuous single loop of chain attached to each of said ends of said curved member;

a stop carried on said chain for preventing movement of said [object] *keys* past said stop, wherein said stop is larger than said aperture of said [object] *keys*; [and]

a removable retaining member carried on said chain in an installed position, [wherein] said retaining member *consisting essentially of a substantially flat member having* [has] an opening [sufficiently large] *slightly larger than said curved member and said chain* to receive a double layer of said chain *and to require precise manipulation to remove said retaining member,* and wherein said [objects] *keys* are held on said chain between said stop and said retaining member in said installed position *and*

*wherein said retaining member is a circular disk with a radius no larger than said distance between said ends of said curved member.*

3. The key chain of claim 1, wherein said curved member and said chain are of a substantially same diameter allowing said [object] *keys* to easily move from said curved member to said chain.

5. The key chain of claim 1, wherein said opening of said retaining member is [sufficiently large] *slightly larger than said curved member and said chain* to simultaneously receive said curved member and said chain *and to require precise manipulation to remove said retaining member.*

7. The key chain of claim 1, *wherein said stop* [further comprising] *comprises* a jumpring [attaching] *to attach* said stop to said chain.

10. A key chain for retaining [objects] *keys* with an aperture, [comprising] *said key chain consisting essentially of*:

a U-shaped member with two ends, said member being substantially rigid and said ends separated from each other by a distance;

a continuous single loop of chain attached to each of said ends of said curved member, wherein said curved member and said chain are of a substantially same diameter allowing said [object] *keys* to easily move from said curved member to said chain;

a stop carried on said chain for preventing movement of said [object] *keys* past said stop, wherein said stop is larger than said aperture of said [object] *keys;* and a removable retaining member carried on said chain in an installed position, wherein said retaining member is a circular disk with a radius no larger than said distance between said ends of said curved member, wherein said retaining member has an opening [sufficiently large] *slightly larger than said curved member and said chain* to receive a double layer of said chain *and to require precise manipulation to remove said retaining member*, and wherein said [objects] *keys* are held on said chain between said stop and said retaining member in said installed position.

*11. The key chain of claim 10, wherein said removable retaining member lays substantially flat against said keys.*

*12. The key chain of claim 1, wherein said removable retaining member lays substantially flat against said keys.*

* * * * *